US005785273A

United States Patent [19]

Wolf et al.

[11] Patent Number: 5,785,273

[45] Date of Patent: Jul. 28, 1998

[54] APPARATUS FOR WINDING OR UNWINDING WEBS, PARTICULARLY PAPER WEBS

[75] Inventors: Robert Wolf, Herbrechtingen; Hans-Joachim Fissmann, Heidenheim, both of Germany

[73] Assignee: Voith Sulzer Papiermaschinen GmbH, Heidenheim, Germany

[21] Appl. No.: 603,459

[22] Filed: Feb. 20, 1996

[30] Foreign Application Priority Data

Feb. 21, 1995 [DE] Germany ..... 195 05 870.4

[51] Int. Cl.[6] ..... B65H 18/20; B65H 18/22

[52] U.S. Cl. ..... 242/541.3; 242/542; 242/542.4

[58] Field of Search ..... 242/542, 542.4, 242/595.1, 541.3

[56] References Cited

U.S. PATENT DOCUMENTS

| | | | |
|---|---|---|---|
| 2,830,775 | 4/1958 | Kiesel | 242/541.3 |
| 3,503,567 | 3/1970 | Casey | 242/542.4 |
| 4,541,585 | 9/1985 | Frye et al. | 242/542.4 |
| 4,837,064 | 6/1989 | Tschudin-Mahrer | 428/71 |
| 4,877,196 | 10/1989 | Heymanns . | |
| 5,150,850 | 9/1992 | Adams | 242/541.3 |
| 5,240,198 | 8/1993 | Dörfel . | |
| 5,335,871 | 8/1994 | Fissmann et al. | 242/595.1 |
| 5,431,358 | 7/1995 | Alexander | 242/542.4 |
| 5,464,169 | 11/1995 | Henseler et al. | 242/542 |
| 5,553,806 | 9/1996 | Lucas | 242/542.4 |
| 5,582,361 | 12/1996 | Muller et al. | 242/542.4 |

FOREIGN PATENT DOCUMENTS

| | | |
|---|---|---|
| 0 294 546 | 12/1988 | European Pat. Off. . |
| 28 49 676 | 6/1979 | Germany . |
| 29 08 294 | 9/1980 | Germany . |
| 87 00 258.2 | 6/1988 | Germany . |
| 87 17 259.3 | 7/1988 | Germany . |
| 91 15 481.2 | 3/1992 | Germany . |
| 40 35 054 | 5/1992 | Germany . |
| 92 04 667.3 | 9/1992 | Germany . |
| 42 08 790 | 9/1993 | Germany . |
| 2 011 028 | 7/1979 | United Kingdom . |

*Primary Examiner*—John M. Jillions
*Attorney, Agent, or Firm*—Marshall, O'Toole, Gerstein, Murray & Borun

[57] ABSTRACT

Apparatus for winding or unwinding of a web includes a support device having at least two king rolls and which may include a supporting belt. A winding roll of a web to be wound or unwound by the apparatus is supported by the king rolls such that a press gap is formed with at least one of the king rolls. At least one of the king rolls has a support body and a shell made from a soft, elastic material, the shell having a plurality of cavities, the cavities opening in a direction opposite a peripheral surface of the support body. In one embodiment the supporting belt includes cavities which may be filled with compressible material. In another embodiment the supporting belt includes a cover layer and a base layer with the base layer being softer than the cover layer.

10 Claims, 4 Drawing Sheets

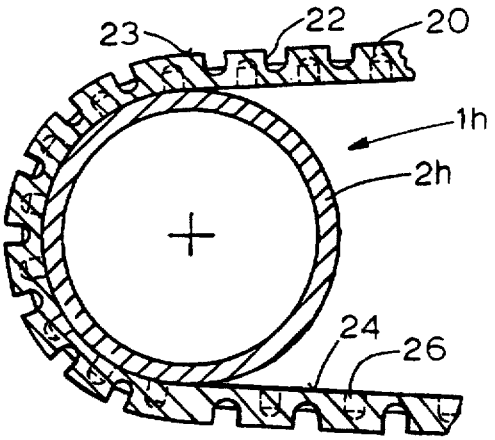
Fig. 3
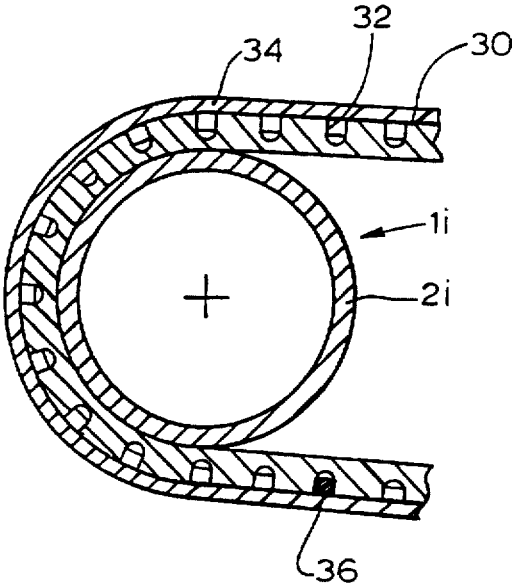
Fig. 4
Fig. 5a
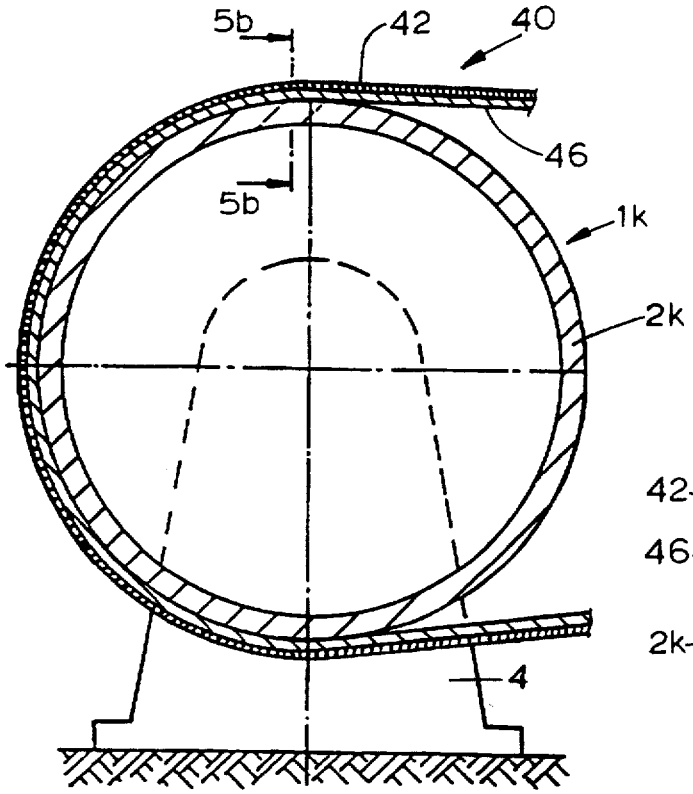
Fig. 5b
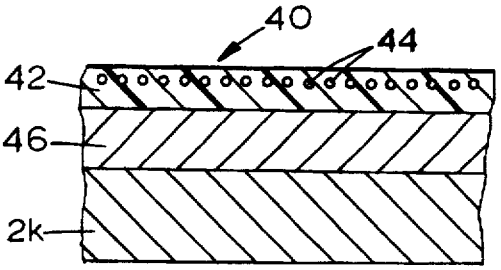

APPARATUS FOR WINDING OR UNWINDING WEBS, PARTICULARLY PAPER WEBS

BACKGROUND OF THE INVENTION

1. Field of the Invention

The invention relates to apparatus for winding or unwinding products that are in the form of webs, particularly paper webs.

2. Description of Related Technology

Apparatus for winding or unwinding of web-like products, especially paper webs may include at least two king (support) rolls making up the winding bed. A winding roll of material to be wound or unwound by the king rolls is connected to the king rolls so that it forms a press gap at least indirectly with the two king rolls. In such an apparatus, one of the king rolls may include a support body that has a surface made from a comparatively soft, rubber or other elastic material, such as polyurethane. The surface of the king roll may include recesses or cavities. A number of measures reflected in the following documents are known to increase the performance of such apparatus:

(1) G 91 15 481;

(2) G 92 04 667;

(3) DE 42 08 790 C2; and (4) DE 29 08 294.

G 91 15 481 concerns a winding machine for axis-free unwinding of a web. It has at least one king roll, as well as a device to relieve one or more king rolls from the weight of the roll being wound. The unloading device includes a device for application of compressed air onto the outer surface of the roll being wound, i.e., the takeup roll carried by the two king rolls is additionally supported in the direction of gravitational force by compressed air. An apparatus for winding or unwinding of web-like products designed in this fashion requires corresponding measures for sealing during application of compressed air to the outer surface of the roll being wound or unwound. This leads to an increase in design cost, and web guiding in such designs is particularly problematical.

A device disclosed in G 92 04 667 (corresponds to U.S. Pat. No. 5,335,871) includes apparatus wherein a front king (support) roll is recessed and the front king roll is a rubberized roll. This offers the advantage that the linear force on the front king roll becomes greater, but smaller on a rear king (support) roll. The takeup roll is then supported more on the front than on the rear king roll. This effect increases with increasing roll diameter. Because of this the first press gap in the running direction, which is generally assigned greater significance for the winding result, is loaded to a lesser degree than in the conventionally designed apparatuses, especially at large roll diameters. In order to avoid adverse effects from the increasing linear force in the second nip a rubber-coated king roll is incorporated there. The nip width in the second nip increases on this account. However, experinents have shown that a desirable increase in performance capability, especially an optimal winding result, is not achieved with this type of device.

Similarly, in DE 42 08 790 C2 (corresponds to U.S. Pat. No. 5,464,169) a front king roll is disclosed which also is set lower, but a shoe roll is used here instead of a rubberized roll, as described in G 92 04 667. The shoe roll includes a flexible, tube-like shell, as well as a hollow support designed as a circular cylinder having support elements for the shell. A support shoe extending over the length of the support or essentially over the width of the paper web is connected to the support, having a running surface that is hydrodynamically lubricated and designed concave according to the maximum winding diameter. A pad roller is also provided, which makes it possible to press the winding tube against the bearing surfaces. In order for the shoe roll and thus the support shoe to carry the greatest part of the winding weight, it is essential that the support shoe be arranged at a much lower level than the uppermost surface line of the rigid king roll.

According to DE 42 08 790 C2, at the beginning of the winding process, when only a small winding tube is present, the support shoe is situated in a lower position. With increasing winding diameter, the support shoe is swiveled further and further upward so that, as in ordinary double-king-roll rollers, it is supported on two elongated regions that are spaced from each other along the periphery of the winding. The shortcoming of this arrangement is that the radius of curvature of the support shoe does not correspond to the smaller diameters of the winding so that there is still no significant advantage here relative to a conventional double-king-roll roller. However, as soon as the winding has reached a size in the range of its maximum diameter, the support surface, on which the winding is supported on the support shoe 5, is significantly increased. Relief of the load therefore only occurs on reaching a certain diameter of the takeup roll, corresponding to almost the maximum winding diameter.

Another apparatus for relieving the load on the king rolls during winding of a takeup roll is described in DE 29 08 294. The apparatus for winding of web-like products includes an endless, elastic belt to relieve the contact force of the winding roll in the winding gap, tightened by a moveable tension roll, in addition to two king rolls. The elastic belt winds around one of the two king rolls and the pressure roll. The rolls looped around by the belt are spatially arranged so that during the entire winding process a load-relief component forms on the weight of the winding roll from the elastic belt.

Despite the measures described in documents (2) to (4), the performance capability of roll cutting machines could not be raised to the sought extent. The negative effects of the increasing linear force in the second nip could be ruled out by the measures described in documents (2) to (4). Nevertheless, the wound rolls exhibit a number of winding defects.

SUMMARY OF THE INVENTION

It is an object of the invention to overcome one or more of the problems described above. It is also an object of the invention to modify an apparatus for winding or unwinding of web-like products of the type discussed thus far herein, i.e., a double-king-roll roller, so that the shortcomings described above are avoided. It also is an object of the invention to achieve an optimal winding result, i.e., obtaining a winding roll free of bulges or similar winding defects. According to the invention, the individual elements forming a nip are designed and arranged so that no shear stresses are transferred to the winding roll from the sides of the support device at least in the region of the first nip in the winding direction of the web-like product.

An apparatus according to the invention for winding or unwinding of a web includes a support device further having at least two king rolls. A winding roll of a web to be wound or unwound by the apparatus is connected to the king rolls such that a press gap is formed at least indirectly with at least one of the king rolls. At least one of the king rolls has a support body and a shell made from a soft, elastic material, the shell having a plurality of cavities, the cavities opening in a direction opposite a peripheral surface of the support body.

Other objects and advantages of the invention will be apparent to those skilled in the art from the following detailed description taken in conjunction with the drawings and the appended claims.

BRIEF DESCRIPTION OF THE DRAWINGS

FIG. 3 is a partially schematic cross-sectional view of a fifth embodiment of an apparatus according to the invention.

FIG. 4 is a partially schematic cross-sectional view of a sixth embodiment of an apparatus according to the invention.

FIG. 5*a* is a partially schematic cross-sectional view of a sixth embodiment of an apparatus according to the invention.

FIG. 5*b* is an enlarged partially schematic sectional view taken along line 5*b*—5*b* of FIG. 5*a*.

DETAILED DESCRIPTION OF THE INVENTION

Figure 1A:
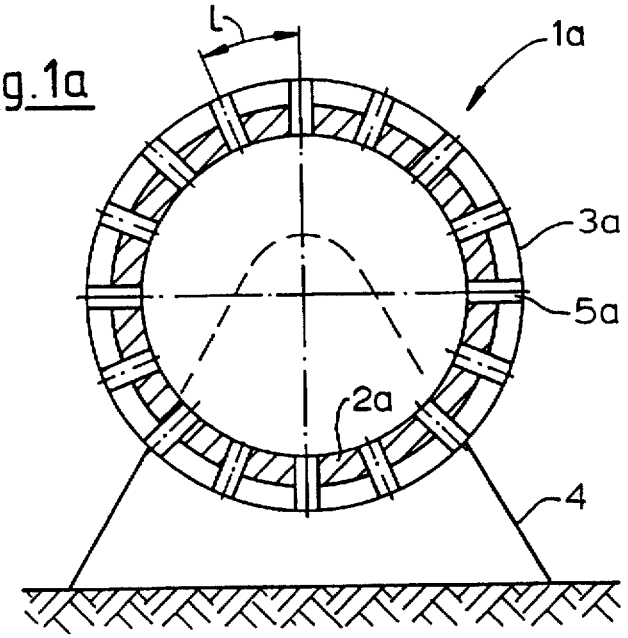
FIG. 1*a* is a partially schematic cross-sectional view of an apparatus according to the invention.

According to the invention, in an apparatus for winding and unwinding of web-like products, especially paper webs, with at least two king rolls to which the roll being wound or unwound can be connected so that it forms at least indirectly a nip with the two king rolls, the individual elements of the support device are designed and arranged so that at least in the region of one nip, preferably the second nip in the winding direction, deflection possibilities are provided for the elastically deforming regions in the nip region of the individual elements forming a nip on the sides of the support device. This means that no shear stresses are transferred to the winding roll from the nip-forming elements on the sides of the support device because of elastic deformations.

The inventors recognized that the positive effects of the variants according to the prior art mentioned in documents (2) to (4) above by a harmful effect of a soft nip, especially a soft second nip in the winding direction of the paper, web can be lessened. For example, in the variants according to documents (2) and (3), the rubber coating used for the front king roll is compressed in the center of the nip. The same also holds for an elastically designed support belt according to a variant of document (4). Since the material employed to coat the king roll or support belt, generally rubber, is incompressible in volume, the displaced material must be moved out of the nip. It will do this primarily in the longitudinal direction of the machine and bulges will form in the region of entry into and emergence from the nip. Since the contact between the winding roll and the rubber coating is not free of friction, expansion of the rubber surface is inhibited by the winding roll. Enormous shear stresses that elongate the uppermost layers of the weblike product on the winding roll then develop on the contact surfaces between the web-like product and the rubber.

Improvement measures are therefore prescribed according to the invention to the extent, for example, that the shear stresses transferred to the winding roll in the second nip are largely reduced or entirely avoided by providing deflection volumes. Two solutions essentially offer themselves for this purpose, which can be combined and when considered alone can be achieved by several modifications.

According to the invention, the following two possibilities exist for a double-king-roll roller in which one of the two king rolls is looped around by the paper web during operation and the other king roll is lowered relative to it so that a plane passed through the axes of the two king rolls forms an angle with the horizontal, and in which the second king roll has a surface that is more deformable than the surface of the first king roll:

1. The second king roll is provided with a coating having regions with cavities as deflection volumes for the coating material.
2. The king roll is provided with a coating that is designed in one or several layers so that the upper layer is particularly resistant to elongation in the peripheral direction.

The first-mentioned cavities can be designed as holes, grooves or the like.

The holes can extend in the form of through-holes through the coating and the roll body of the king roll. Blind holes are only provided in the coating. These can be disposed, for example, in the region of the inner surface of the coating and the outer surface of the coating.

Grooves can be disposed to run in the peripheral direction, in a spiral or sloped relative to each other in the peripheral direction. The possibility also exists of arranging the rolls in the region of the outer surface and/or the inner surface of the coating. In the first named case these can be additionally closed with a cover layer.

The cavities designed as holes, grooves, etc. can be filled with a readily compressible material, for example, foam. This offers the advantage of prevention of soiling and the least possible noise generation. Also, the cavities may be closed (i.e. covered) with a thin cover layer on their surface. This expedient according to the invention may also be combined with filling of the cavities.

A second possibility according to the invention consists of designing the built-up coating in one or more layers so that the upper layer, which comes in contact with the winding roll, is particularly resistant to elongation in the peripheral direction. This can be done by making the outer layer hard and the inner layer soft in multilayered coatings. There is also a possibility in a multilayered coating of providing the inner layer with cavities according to the aforementioned explanations of the invention. Also an elongation-resistant reinforcement can be provided in the coating in the region of the surface, i.e., in the region of the outer periphery of the king roll.

Also according the invention, one can use a coating material with a Poisson's ratio <0.5. The coating can then be made from a material with included gas bubbles or also foam.

A king roll with volume-compressible regions configured according to the invention can be used in different king roll winding devices.

The individual king rolls can be arranged so that the joining plane between their axes forms an angle with the horizontal or coincides with it. In addition, in both instances the king rolls can have the same diameter or different diameters. One or both of the king rolls can be designed according to the invention. Such a choice occurs according to the application requirements.

Another similar variant according to the invention consists in supporting the winding roll with an appropriately configured support belt. In such an embodiment, corresponding configuration of the king roll, especially configuration of the king roll coating, can be dispensed with, since primarily the winding roll comes in contact with the support belt in the nips. In this case as well the same opportunities are offered for designing the support belt as for the configuration of the coating.

To increase performance, the cited variants can additionally be combined with the already known conventional possibilities for increasing performance. These include compressed air unloading, for example, the use of a compressed air box that is connected to the winding roll and can be raised and lowered relative to it. There is also the possibility of providing the compressed air boxes with a separation device for the web-like product.

The configuration and layout of an apparatus according to the invention for unwinding and winding of webbed products permits an increase in performance to the extent that rolls with larger diameter can be produced without roll defects, for example, broken ends or creases, since no interfering factors occur in the nips during winding and unwinding. The positive effects of the variants described in documents (2) to (4) can be retained, whereas the negative effects can be largely eliminated by using appropriately configured king rolls or support belts. Thus, according to the invention, an apparatus is designed having at least one of the two nips in a double-king-roll roller, which can form the winding roll with the two king rolls, generally the second nip in the winding direction, as an almost soft nip, but in which no shear stresses are transferred to the winding roll.

Figure 1B:
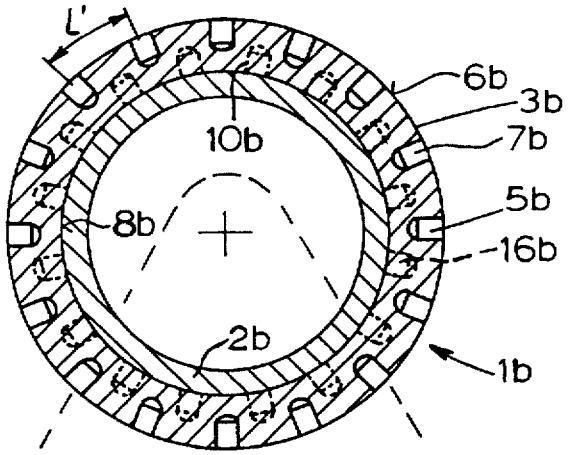
FIG. 1*b* is a partially schematic cross-sectional view of a second embodiment of an apparatus according to the invention.
Figure 1C:
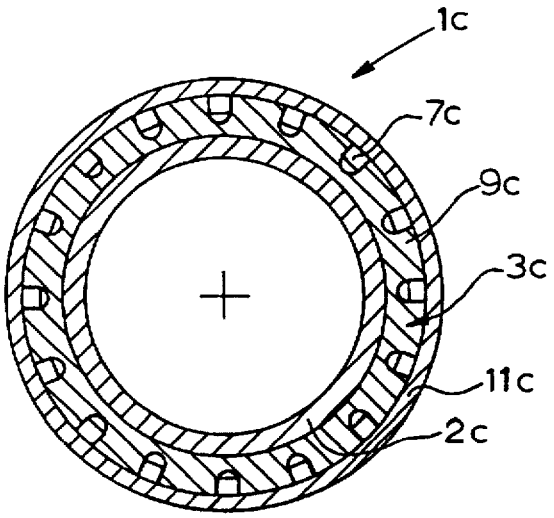
FIG. 1*c* is a partially schematic cross-sectional view of a third embodiment of an apparatus according to the invention.
Figure 1D:
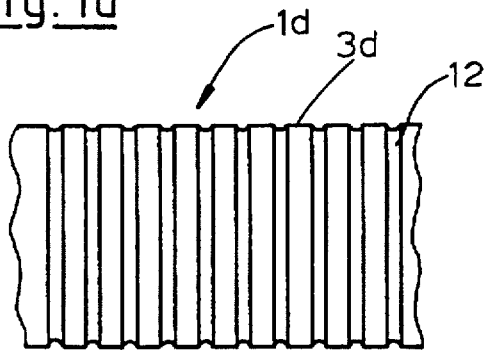
FIG. 1*d* is a top view of an embodiment of a surface of a king roll according to an apparatus of the invention.
Figure 1E:
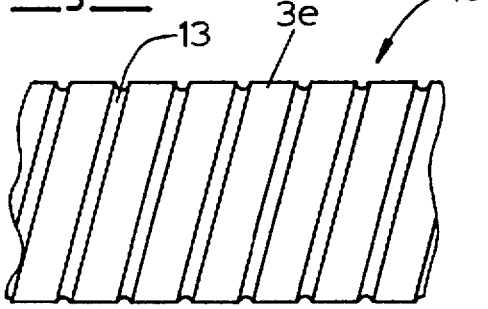
FIG. 1*e* is a top view of a second embodiment of a surface of a king roll according to an apparatus of the invention.
Figure 2A:
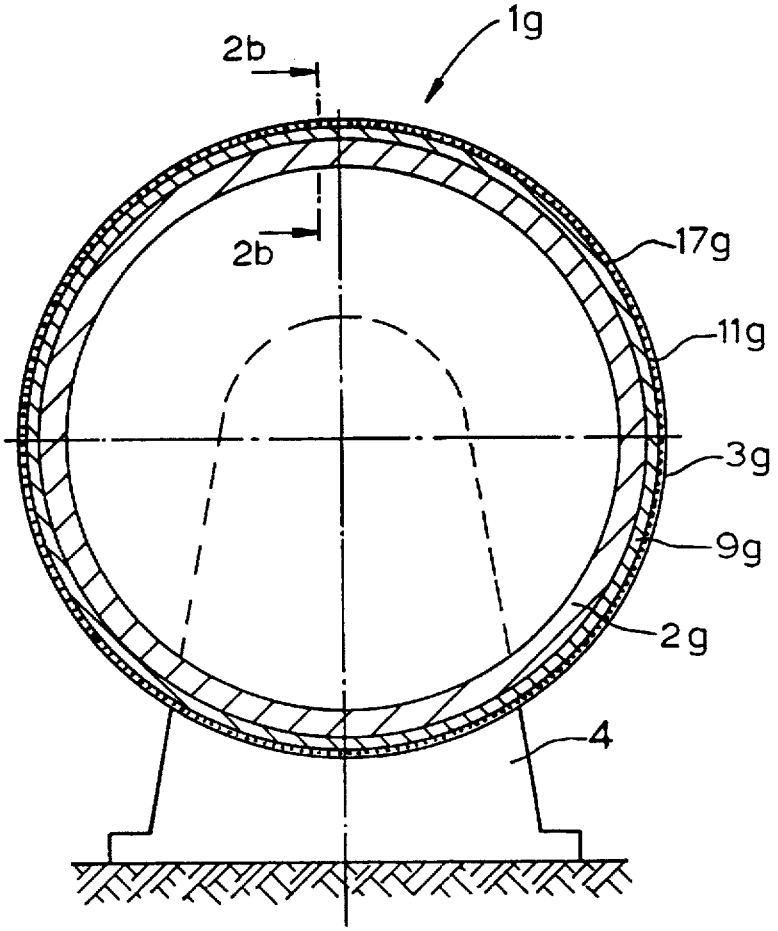
FIG. 2*a* is a partially schematic cross-sectional view of a fourth embodiment of an apparatus according to the invention.
Figure 2B:
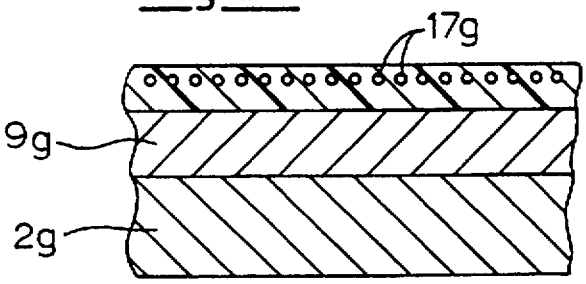
FIG. 2*b* is an enlarged partially schematic sectional view taken along line 2*b*—2*b* of FIG. 2*a*.

Accordingly, the invention is further explained with reference to the figures in which the following is presented:

FIGS. 1*a* to 1*c* schematically depict variants of a king roll coating according to the invention with deflection volumes with reference to a king roll shown in cross section, the coatings shown on the king rolls having volume-compressible regions in the form of deflection volumes; FIGS. 1*d* to 1*e* show variants of a king roll coating according to the invention with reference to a top view of a king roll; and FIGS. 2*a* and 2*b* depict the two-layered variant of a king roll coating according to the invention with an elongation-resistant upper layer in the peripheral direction.

A king roll 1*a* is depicted schematically in cross section in FIG. 1*a*. This comprises a metal roll body 2*a* and a coating or shell 3*a*. The king roll 1*a* is mounted, for example, on a frame 4. The coating or shell 3*a* is designed in one layer and includes cavities 5*a* disposed therein. The cavities 5*a* are shown in FIG. 1*a* as through-holes extending through the coating 3*a* and the metal roll body 2*a*. The cavities 5*a* are preferably disposed at equal distances 1 from one another in a peripheral direction on the king roll 1*a*. Moreover, the cavities 5*a* can be disposed at specified spacings over the width of the king roll 1*a* corresponding to the requirements of the particular application for which the rolls are being used. The cavities or holes 5*a* preferably have a circular cross section.

A modification of the embodiment shown in FIG. 1*a* (not shown) according to the invention may include the roll body 2*a* being perforated or having blind holes, and the coating 3*a* being made of a homogeneous layer that permits compressibility of the coating in the region of the outside periphery of the roll body 2*a*.

FIG. 1*b* shows a king roll 1*b* provided with a roll body 2*b* and a coating 3*b* having cavities 5*b* in the form of blind holes. The basic structure corresponds to that described in FIG. 1*a*. Therefore, the same reference numbers are used for similar elements followed by a "b" instead of an "a" Hereafter, with respect to further embodiments according to the invention, elements having the same function will be identified using the same reference numbers but followed by a lower case letter (e.g., c, d, etc.).

With respect to the embodiment shown in FIG. 1*b*, the king roll 1*b* also has a metal roll body 2*b*, having a surface which is covered by a coating 3*b*. The coating 3*b* is also preferably designed in one layer and has blind holes 7*b* extending into the coating 3*b* in the region of its outer periphery 6*b*, which corresponds to the outer periphery of the king roll 1*b* with the applied coating. The holes 7*b* are also disposed at specified spacings 1' and oriented in the peripheral direction, the spacing corresponding to the requirements of the particular application of the king roll 1*b*. The same holds true for the arrangement of the blind holes over the width of the king roll.

However, there is also the possibility (shown in phantom in FIG. 1b) of providing blind holes on an inside periphery 8*b* of the coating 3*b*. The blind holes are designated by as 10*b* in FIG. 1*b*. This offers the advantage of an essentially smooth configuration of the outer surface on the outer periphery 6*b* of the king roll 1b.

FIG. 1*c* shows another embodiment of an apparatus according to the invention wherein the king roll 1*c* includes a roll body 2*c* and a coating 3*c* which has cavities 7*c* therein that are closed (i.e. covered) by a thin cover layer 11*c* on the surface of the coating 3*c*. The embodiment shown in FIG. 1*c* corresponds essentially to that described in FIG. 1*b*, for which reason the same reference numbers are used for the same elements. The coating 3*c*, however, also has 4 the cover layer 11*c* disposed radially outward in addition to at least a one or multilayered base layer 9*c*. This should be designed significantly harder than the radially inward part of the coating. The cover layer, as shown in FIG. 1*c*, can be designed unperforated, but can also be perforated for the purpose of noise reduction.

An advantage of the cover layer, which essentially serves to cover cavity 7*c*, consists of preventing soiling of the cavities and a reduction in noise generation.

The embodiment according to the invention depicted in FIGS. 1*a* and 1*b* show roll coatings made in one layer. However, there is also the possibility of using a multilayered coating. By analogy this assertion also holds for the embodiment disclosed in FIG. 1*c*. In addition to the cover layer, the coating can also have a multilayered base layer.

FIGS. 1*d* to if schematically depict various embodiments of a king roll coating in a top view of a king roll (similar to the king rolls shown in any of FIGS. 1*a*–1*c*) designed according to the invention. For purposes of clarification, the cavities shown are not depicted to scale.

Figure 1F:
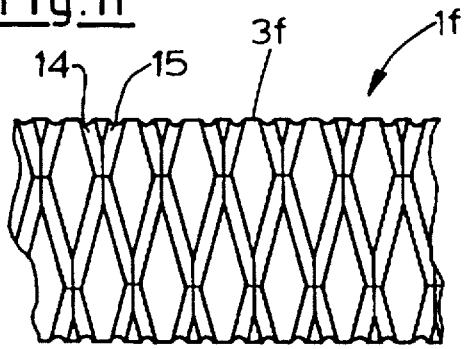
FIG. 1*f* is a top view of a third embodiment of a surface of a king roll according to an apparatus of the invention.

FIG. 1*d* shows grooves 12 running in the peripheral direction on a coating 3*d*. FIG. 1*e* shows grooves 13 running in spiral fashion in a coating 3*e*, and FIG. 1*f* depicts obliquely lying, intersecting grooves 14 and 15 in a coating 3*f*. The grooves 12 to 15 can be arranged in a one or multilayered base layer and can additionally be covered by a cover layer, e.g., the layer 11*c* shown in FIG. 1*c*.

To avoid noise generation, the differently configured cavities can be filled with a readily compressible material, for example, foam, and possibly further closed with a cover layer.

Another possible embodiment of an apparatus according to the invention is depicted in FIGS. 2*a* and 2*b*. A king roll 1*g* also comprises a preferably metal support body 2*g* and a coating 3*g*. The coating 3*g* comprises a base layer 9*g* and a cover layer 11*g*. The base layer 9*g* is produced from a material softer than that of the cover layer 11*g*. An elongation-resistant layer 17*g* in the form of wound peripheral threads are provided in the peripheral direction in the cover layer 11*g*.

FIG. 2*b* shows an enlarged section from the coating 3*g* according to FIG. 2*a*. The cover layer 11g can be produced from an elastomeric material, for example, polyurethane. Threads 17*g* running essentially in the peripheral direction are incorporated in the cover layer. The configuration and production of a coating designed in this fashion can occur according to DE 40 22 800 C1.

The possibilities for creating the deflection possibilities for the roll coating or individual layers of the coating depicted in the figures can be transferred by analogy to an endless belt supporting the winding roll and looping around the two king rolls.

With respect to the embodiment shown in FIG. 3, the king roll 1*h* has a metal roll body 2*h*, having a surface which is looped about by an endless elastic support belt 20. The belt 20 has recesses 22 (blind holes) extending into the belt 20 in the region of its outer periphery 23.

However, there is also the possibility (shown in phantom in FIG. 3) of providing blind holes 26 on an inside periphery 24 of the belt 20. This offers the advantage of an essentially smooth surface on the outer periphery 23 of the belt 20.

FIG. 4 shows another embodiment of an apparatus according to the invention wherein the king roll 1*i* includes a roll body 2*i* and an elastic endless support belt 30 which has cavities 32 therein that are closed (i.e. covered) by a thin cover layer 34 on the surface of the belt 30. The cavities 32 may be filled with a readily compressible material, for example, foam 36.

FIGS. 1*d* to 1*f* also schematically depict various embodiments of an elastic support belt in a top view of the belt, designed according to the invention.

Another possible embodiment of an apparatus according to the invention is depicted in FIGS. 5*a* and 5*b*. A king roll 1*k* also comprises a preferably metal support body 2*k* and an elastic endless support belt 40. The belt 40 comprises a cover layer 42 and a base layer 46. The base layer 46 is produced from a material softer than that of the cover layer 42. An elongation-resistant layer 44 in the form of wound peripheral threads are provided in the peripheral direction in the cover layer 42.

FIG. 5*b* shows an enlarged section from th e belt 40 according to Fig. 5*a*. The cover layer 42 can be produced from an elastomeric material, for example, polyurethane. Threads 44 running essentially in the peripheral direction are incorporated in the cover layer.

The foregoing detailed description is given for clearness of understanding only, and no unnecessary limitations should be understood therefrom, as modifications within the scope of the invention will be apparent to those skilled in the art.

We claim:

1. Apparatus for winding or unwinding a web comprising:

a support device comprising at least two king rolls, a winding roll of a web to be wound or unwound connected to the king rolls to form a press gap with at least one of the king rolls, at least one of the two king rolls is looped around by an elastic support belt, the support belt has a layer of soft, elastic material, the soft layer has cavities.

2. The apparatus of claim 1 wherein the cavities are blind holes.

3. The apparatus of claim 1 wherein the cavities are grooves running essentially in a peripheral direction about the at least one king roll.

4. The apparatus of claim 1 wherein the cavities are grooves running at an angle to a peripheral direction about the at least one king roll.

5. The apparatus of claim 1 wherein the cavities are filled with a readily compressible material.

6. The apparatus of claim 5 wherein the cavities are filled with foam.

7. The apparatus of claim 1 wherein the cavities are closed with a thin cover layer.

8. The apparatus of claim 1 wherein the support belt is designed resistant to elongation in the region of its outer surface in a running direction thereof.

9. The apparatus of claim 8 wherein an elongation-resistant reinforcement is embedded in the radial direction in a region of the outer surface of the support belt.

10. The apparatus of claim 1 wherein the cavities are open to an outer peripheral surface of the belt.

* * * * *